US008985240B2

(12) United States Patent
Winnard

(10) Patent No.: US 8,985,240 B2
(45) Date of Patent: Mar. 24, 2015

(54) HANDHELD DRIVE DEVICE

(76) Inventor: Stanley D. Winnard, Irving, TX (US)

( * ) Notice: Subject to any disclaimer, the term of this patent is extended or adjusted under 35 U.S.C. 154(b) by 530 days.

(21) Appl. No.: 13/417,049

(22) Filed: Mar. 9, 2012

(65) Prior Publication Data

US 2013/0062090 A1 Mar. 14, 2013

Related U.S. Application Data

(60) Provisional application No. 61/451,697, filed on Mar. 11, 2011.

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |
| ***B25B 17/02*** | (2006.01) |
| ***B25B 17/00*** | (2006.01) |

(52) U.S. Cl.

CPC ..... *B25B 17/02* (2013.01); *B25B 17/00* (2013.01)

USPC ..... 173/216

(58) Field of Classification Search

USPC ..... 173/45–48, 146, 176, 93, 93.5, 93.6, 173/93.7, 216

See application file for complete search history.

(56) References Cited

U.S. PATENT DOCUMENTS

| | | | | |
|---|---|---|---|---|
| 2,634,630 | A * | 4/1953 | Johnson | 475/270 |
| 4,475,420 | A * | 10/1984 | Atkinson et al. | 81/58.3 |
| 6,352,127 | B1 * | 3/2002 | Yorde | 173/216 |
| 6,510,903 | B2 * | 1/2003 | Funfer | 173/48 |
| 7,191,677 | B2 * | 3/2007 | Barkdoll | 74/396 |
| 7,770,494 | B2 * | 8/2010 | Cornwell et al. | 81/57.3 |
| 7,841,329 | B2 * | 11/2010 | Yang | 124/66 |
| 2002/0037785 | A1 * | 3/2002 | Wissmach et al. | 475/149 |

* cited by examiner

*Primary Examiner* — Robert Long

(74) *Attorney, Agent, or Firm* — Wilson Daniel Swayze, Jr.

(57) ABSTRACT

The present invention provides a handheld driver having a housing with a handle and a trigger that drives a set of gears to rotate a shaft having a fitting for a socket, screwdriver bit or drill bit.

19 Claims, 10 Drawing Sheets

HANDHELD DRIVE DEVICE

CROSS-REFERENCE TO RELATED APPLICATIONS

This application claims priority based on U.S. Provisional Application No. 61/451,697, filed Mar. 11, 2011. The contents of which is incorporated by reference in its entirety.

TECHNICAL FIELD OF THE INVENTION

The present invention relates in general to the field of handheld drive devices and, in particular, to a squeeze driver comprising a housing that encloses a gear body with a variety of gears mounted on a protruding shaft that optionally locks for bidirectional movement of a top and bottom gear upon trigger. A rotatable shaft extends outwardly from the housing and comprises cylinders with a pinion gear that engages with the top and bottom gear to pull-out or push-in screws.

BACKGROUND OF THE INVENTION

Without limiting the scope of the invention, its background is described in connection with screwdrivers and related devices.

U.S. patent application Ser. No. 12/567,152 to Shiyu Sun discloses a screwdriver handle having a storage compartment comprising a connecting rod, a handle body and a rear cap connected in series. The connecting rod includes rod body, which is equipped with hollow plug hole inside, and the other end of the rod body is connected to the handle body. The handle body is provided with a storage compartment that can hold precision screwdriver and spare sleeve.

U.S. Pat. No. 4,114,663 issued to Brynley Viner (1978) discloses a screwdriver body including a tubular housing axially movable with respect to the remainder of the body. An automatic screwdriving and feeding apparatus has a screwdriver body with a tubular housing axially moveable thereon. Screw holding elements are mounted in the tubular housing and are resiliently biased inwardly, or are resiliently deformable, so as to hold a screw for driving. Drive means in the body can move axially relatively to engage the screw and apply rotary drive. Feed means supply screws one at a time to the screw holding elements.

SUMMARY OF THE INVENTION

The present invention provides a squeeze screwdriver device with a mechanism that triggers an optionally locking shaft perpendicular to a bottom and top gear. The squeeze screwdriver of the present invention comprises a) a housing having i) a rotatable extension shaft with cylindrical pieces and a pinion gear, and ii) a handle, b) a gear body with a bottom gear, a protruding shaft, top gear, and c) an engaging mechanism between the cylindrical pieces and gears. The trigger engages the gears connected to the shafts. The gears can then engage and optionally lock the shaft to pull-out or push-in screws.

In one embodiment the present invention provides a handheld device for rotating a drive shaft comprising: a housing comprising a handle extending from a gear housing; a first shaft that extends rotatably through the housing; a first drive gear secured to the first shaft; a trigger pivotably connected to the first shaft to position the trigger adjacent to the handle, wherein the movement of the trigger rotates the first shaft and first drive gear; a second shaft gear in contact with the first drive gear and supported on a second shaft that extends rotatably through the housing; a second drive gear positioned on the second shaft; a third shaft gear in contact with the second drive gear and supported on a slidable third shaft that extends rotatably through the housing and is slidable in the housing and the third shaft gear remains in contact with the second drive gear when slid; a third forward gear attached to the slidable third shaft on one side of the third shaft gear; a third reverse gear attached to the slidable third shaft on the other side of the third shaft gear; a pinion gear positioned between the third forward gear or the third reverse gear to engage selectively the third forward gear or the third reverse gear as a result of the position of the slidable third shaft; and a pinion shaft extending outwardly from the pinion gear through the housing, wherein the movement of the trigger rotates the gears to rotate the pinion shaft.

The housing is constructed from a metal, an alloy, a plastic, a composite material or any combinations thereof. The pinion shaft comprises a head to fit a socket, a hex or a bit. The pinion shaft turns at a ratio of 1.5:1, 2.5:1, 3.5:1, 4.5:1, 5.5:1, 6.5:1, 7.5:1, 8.5:1, 9.5:1, 10.5:1, 1:1, 2:1, 3:1, 4:1, 5:1, 6:1, 7:1, 8:1, 9:1, 10:1, 11:1, 12:1, 13:1, 14:1, 15:1, 20:1, 25:1, 50:1, 60:1, 70:1, 80:1, 90:1, 100:1, 125:1, 150:1, 175:1, 200:1, 225:1, 250:1, 275:1, 300:1, 325:1, 350:1, 375:1, 400:1, 450:1, 475:1, 500:1, or more when compared to the trigger motion. The pinion shaft further comprises a direct drive gear to lock the pinion shaft.

In one embodiment the present invention provides a handheld device for rotating a drive shaft comprising: a housing comprising a handle extending from a gear housing; a first shaft that extends rotatably through the housing; a first drive gear secured to the first shaft; a trigger pivotably connected to the first shaft to position the trigger adjacent to the handle, wherein the movement of the trigger rotates the first shaft and first drive gear; a second shaft gear in contact with the first drive gear and supported on a slidable second shaft that extends rotatably through the housing and is slidable in the housing and the second shaft gear remains in contact with the first drive gear when slid; a second forward gear attached to the slidable second shaft on one side of the second shaft gear; a second reverse gear attached to the slidable second shaft on the other side of the second shaft gear; a pinion gear positioned between the second forward gear or the second reverse gear to engage selectively the second forward gear or the second reverse gear as a result of the position of the slidable second shaft; a pinion shaft extending outwardly from the pinion gear through the housing, wherein the movement of the trigger rotates the gears to rotate the pinion shaft.

In one embodiment the present invention provides a device for pulling-out or pushing-in a screw comprising: a housing; a gear body disposed in the housing wherein a protruding shaft moveably secures perpendicular to a bottom gear and a top gear; a trigger that engages the bottom gear and the top gear, wherein the trigger moves the top gear and the bottom gear; the trigger selectively engages the bottom gear wherein rotation of the bottom gear in a first rotational direction rotates the top gear and rotation of the bottom gear in a second rotational direction rotates the top gear in an opposite direction; a rotatable shaft extending outwardly from the housing body; one or more cylindrical pieces comprising a pinion gear and a screw opposite the pinion gear disposed in the rotatable shaft; the rotatable shaft selectively rotates the pinion gear in a first rotational direction or a second rotational direction opposite the first rotational direction; a handle to grip while the trigger sets in motion the bottom gear and the top gear and the one or more cylindrical pieces and the screw.

BRIEF DESCRIPTION OF THE DRAWINGS

For a more complete understanding of the features and advantages of the present invention, reference is now made to the detailed description of the invention along with the accompanying figures.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The present invention is a device for pulling-out or pushing-in a screw comprising a gear body with a bottom and top gear attached to a protruding perpendicular shaft within a housing which has a rotatable extension shaft with two cylindrical pieces containing a pinion gear, a handle, squeeze trigger and engaging mechanism between trigger and gears.

Figure 1:
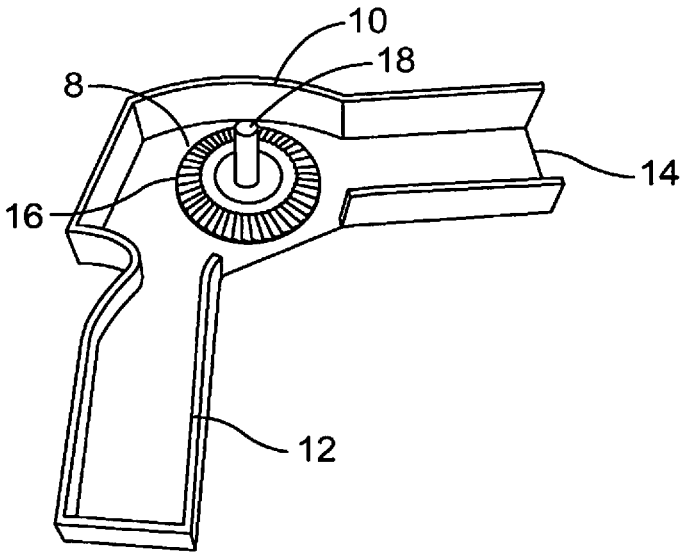
FIG. 1 shows a top side perspective view, of the gear body with a bottom gear and protruding shaft within the housing which has a rotatable extension shaft and handle, of the present invention.

FIG. 1 shows the housing 10 of the present invention. The housing encloses a gear body 8 comprising a bottom gear 16 mounted on a protruding shaft 18. A rotatable extension shaft 14 and handle 12 extend outwardly from the housing.

Figure 2:
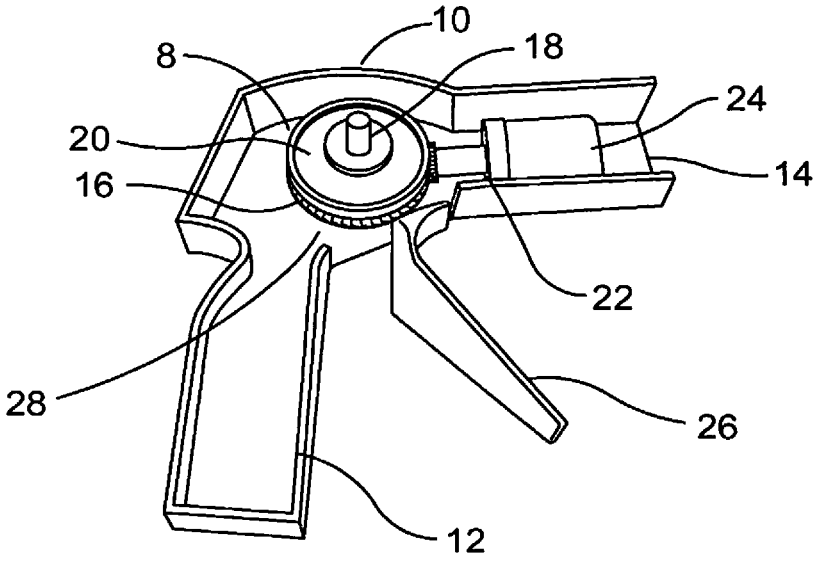
FIG. 2 shows a top side perspective view, of the gear body with a bottom and top gear attached to a protruding shaft within the housing which has a rotatable extension shaft with two cylindrical pieces, a handle, squeeze trigger and engaging mechanism between trigger and gears, of the present invention.

FIG. 2 shows the housing 10 of the present invention. The housing encloses a gear body 8 comprising a bottom gear 16 mounted on a protruding shaft 18. A rotatable extension shaft 14 and handle 12 extend outwardly from the housing. In addition, FIG. 2 shows the top gear 20 also mounted on the protruding shaft 18, the cylinders with the pinion gear 24 and 22 respectively, the trigger 26 and the trigger engaging with the top and bottom gears 28.

Figure 3:
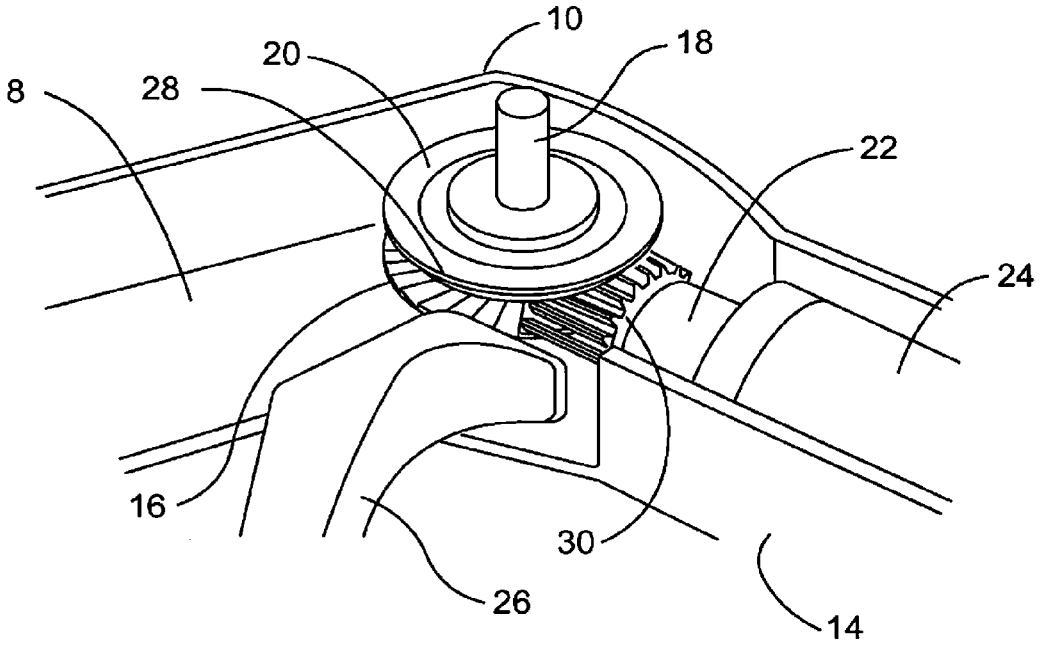
FIG. 3 shows a lateral perspective view of the gear body with a bottom and top gear attached to a protruding shaft within the housing which has a rotatable extension shaft with two cylindrical pieces, a handle, squeeze trigger and engaging mechanism between trigger and gears; the pinion gear attached to the cylindrical pieces and in contact with the top and bottom gears of the present invention is also shown.

FIG. 3 shows a lateral perspective view of the housing 10 of the present invention. The housing encloses a gear body 8 comprising a bottom gear 16 mounted on a protruding shaft 18. A rotatable extension shaft 14 and handle 12 (not shown) extend outwardly from the housing. FIG. 3 shows the top gear 20 also mounted on the protruding shaft 18, and the cylinders with the pinion gear 24 and 22 respectively. In addition, FIG. 3 shows a close-up of the pinion gear 30 engaging the top and bottom gears. The trigger 26 and the trigger engaging with the top and bottom gears 28 are also shown.

Figure 4:
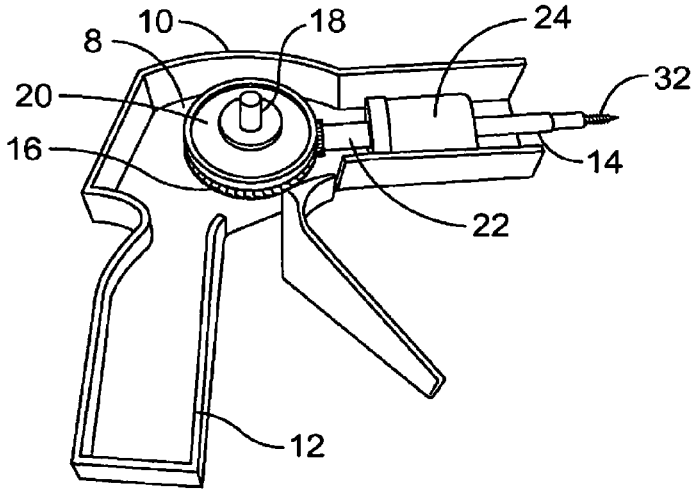
FIG. 4 shows a top side perspective view of the gear body with a bottom and top gear attached to a protruding shaft within the housing which has a rotatable extension shaft with two cylindrical pieces, a handle, squeeze trigger and engaging mechanism between trigger and gears; the pinion gear attached to the cylindrical pieces and in contact with the top and bottom gears is also shown along with the opposite facing screw protruding from the cylindrical pieces of the present invention.

FIG. 4 shows the housing 10 of the present invention. The housing encloses a gear body 8 comprising a bottom gear 16 mounted on a protruding shaft 18. A rotatable extension shaft 14 and handle 12 extend outwardly from the housing. FIG. 4 shows the top gear 20 also mounted on the protruding shaft 18, and the cylinders with the pinion gear 24 and 22 respectively. Additionally, FIG. 4 shows the cylinder engaging the screw 32.

Figure 5:
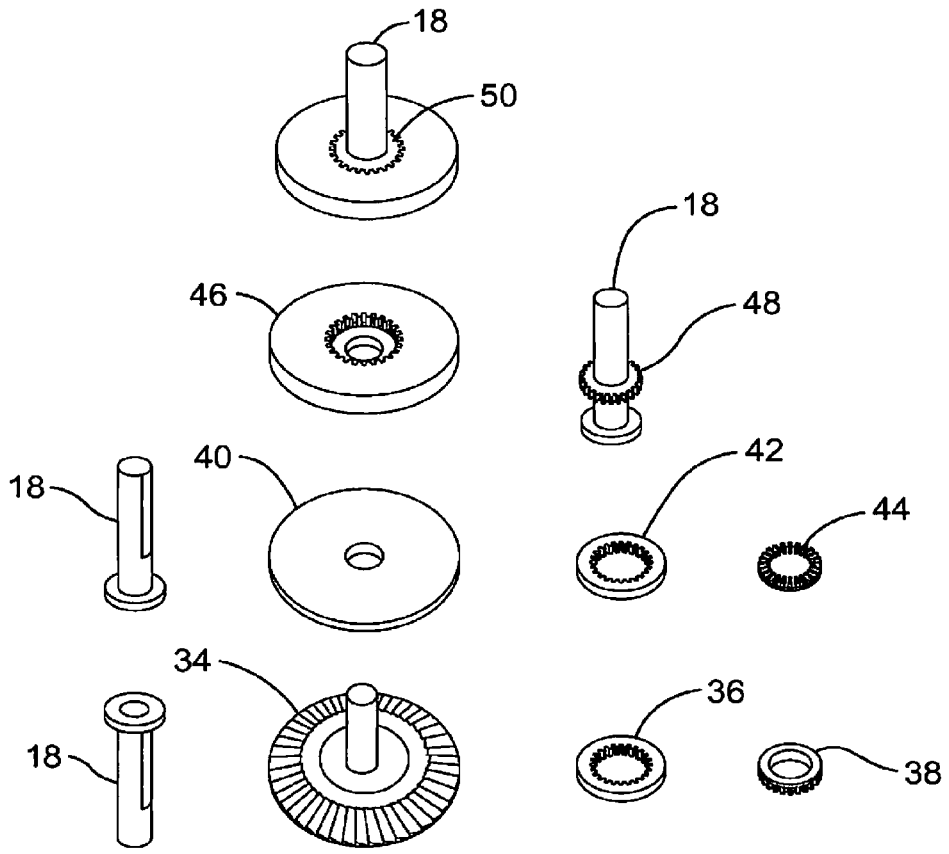
FIG. 5 shows how to mount the gears on the moveable locking shaft of the present invention.

FIG. 5 shows how to mount the top and bottom gears onto the protruding shaft 18. A variety of gears, including a bevel gear 34, an internal gear 36, an external gear 38, a spur gear 40, another internal gear 42 and a crown gear 44 are depicted. The bevel gear 34, internal gear 36 and external gear 38 are combined into one disc (not shown). The spur gear 40, second internal gear 42 and crown gear 44 are similarly combined into a second disc (not shown). The two discs are then combined into a final disc 46 that constitutes either the top or bottom gear. The final disc is mounted onto the locking shaft 48. A close-up of the mounted final disc is shown in 50.

Figure 6:
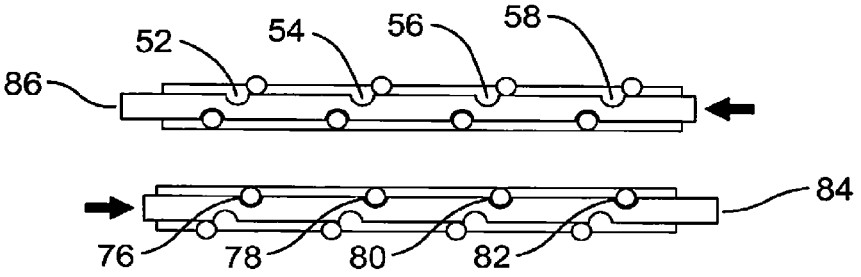
FIG. 6 shows a lateral view of the locking shaft in the locked and unlocked positions of the present invention.

FIG. 6 shows the dual locking shaft mechanism, 86 and 84 respectively. The unlocked positions are depicted in 52, 54, 56 and 58. The locked positions are depicted in 76, 78, 80 and 82.

Figure 7:
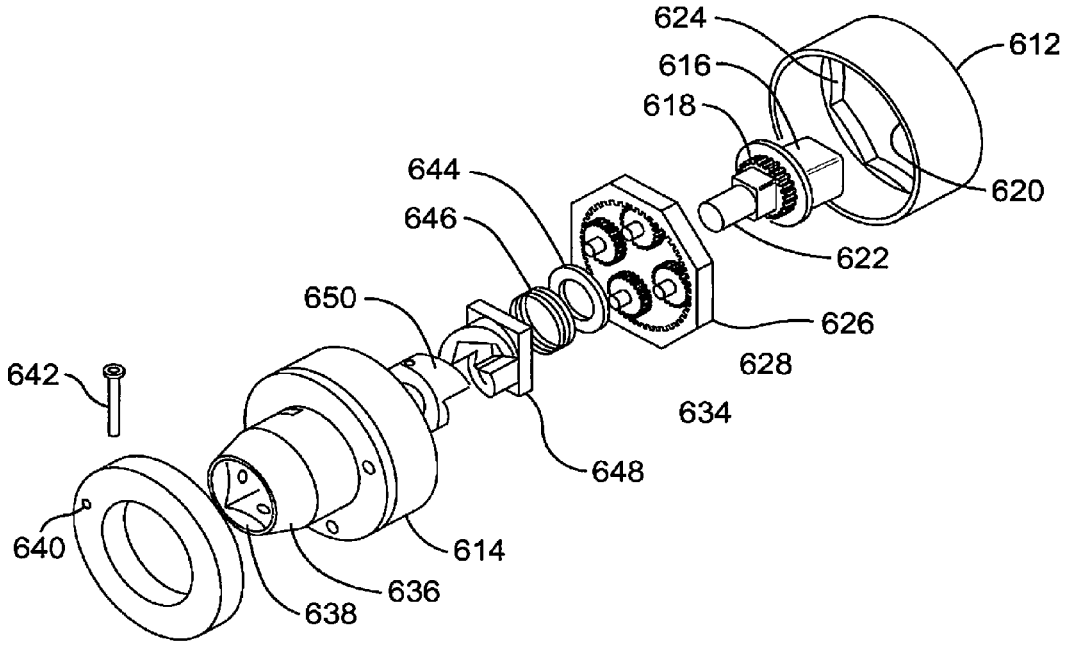
FIG. 7 is an exploded isometric image of the gearing system with a multiplier gear set used as a drive extension.

FIG. 7 is an exploded isometric image of the gearing system with a multiplier gear set used as a drive extension. The drive extension may be used in numerous devices from ratchets, sockets, transmissions, drivelines and so forth. The drive extension 610 includes a first body 612 and the second body 614 that mate. The first body 612 includes a first connection end 616 adjacent a first gear portion 618. The first head 612 includes a gear cavity 620 positioned within the first head 612 to receive a first connection end 616 connected to a first gear portion 618, with a shaft 622 in this case a planetary gear but may be other types of gears. The first body 612 includes a ring gear aperture 624 to accept a ring gear 626. In this embodiment, the ring gear aperture 624 is polygonal but may have any shape necessary. The ring gear aperture 624 and the ring gear 626 may be constructed from a single piece and integrated into a single device. The size, shape, material, position and so forth may be varied for a particular application. The ring gear 626 includes an inner aperture 628 with inner ring teeth 630 positioned thereon. The outer wall 632 is configured to be secured within the ring gear aperture 624. A set of gears 634 are positioned within the inner aperture 628 to contact the inner ring teeth 630 and the first gear portion 618. The set of gears 634 may include 1, 2, 3, 4, 5, 6, 7, 8, 9, 10 or more gears with different or similar tooth spacing. The set of gears 634 are connected to the second body 614 that includes a second connection end 636 adjacent a second body 614. The second connection end 636 also includes a second connection aperture 638 designed to accept a drive device (not shown) that may be a socket, a ratchet, a wrench, a head, an extension, a bit, a drill bit and other devices known in the art. A thumb wheel 640 is also attached to the second body 614 and may be attached by screw 642 or weld (not shown). The shaft 622 is connected to one or more washers 644, a bias mechanism 646, a first slide tip 648 and a second slide tip 650. In operation, the second connection aperture 638 is fitted to a ratchet. As it rotates, the shaft 622 rotates and causes the set of gears 634 to rotate and the first gear portion 618 rotates the first connection end 616. The first connection end 616 can be adapted to fit a ratchet, a wrench, a head, an extension, a bit, a drill bit and other devices known in the art. In another embodiment, the ring gear 626 includes an inner aperture 628 with inner ring teeth 630 positioned thereon and the outer wall 632 is configured to be secured within the ring gear aperture 624. The set of gears 634 are positioned to allow the insertion and removal of an interchangeable connection gear (not shown) having a first connection end 616 connected to a first gear portion 618, with a shaft 622. The interchangeable connection gear (not shown) can be inserted similarly to a spline drive wrench and allow the interchange of the various drive sizes (¼, ½, ¾, 1, etc.) at the first connection end 616.

Figure 8:
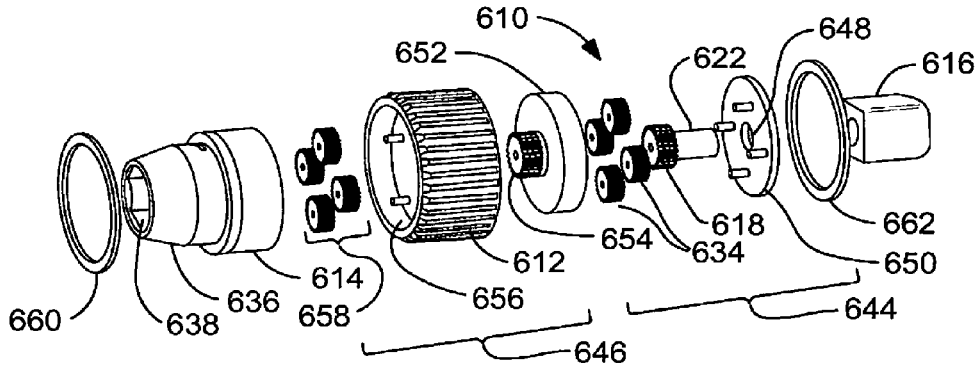
FIG. 8 is an exploded isometric image of the gearing system with a double multiplier gear set used as a drive extension.

FIG. 8 is an exploded isometric image of the gearing system with a double multiplier gear set used as a drive extension. The drive extension may be used in numerous devices from ratchets, sockets, transmissions, drivelines and so forth. The drive extension 610 includes a first body 612 and the second body 614 that includes a first gear set 644 and a second gear set 646 to provide a different multiplier ratio for the drive. The shaft 622 extends through the first plate aperture 648 into the first connection end 616 on one side of a first gear plate 650 with first gear portion 618 positioned on the opposite side of the first gear plate 650. The first connection end 616 can be adapted to fit a ratchet, a wrench, a head, an extension, a bit, a drill bit and other devices known in the art. Surrounding the first gear portion 618 is a first set of gears 634 sandwiched between first gear plate 650 and second gear plate 652. A second gear portion 654 positioned on the opposite side of the second gear plate 652. In this case, a planetary gear but may be other types of gears. The first head 612 includes a first gear cavity (not shown) and a second gear cavity 656 positioned within the first head 612 to receive the second gear portion 654 through an aperture (not shown). The second set of gears 658 is positioned within the second gear cavity 656 and contacts the second gear portion 654. The second set of gears 658 are secured between the first body 612 and the second body 614. The second body 614 includes a second connection end 636 and a second connection aperture 638 designed to accept a drive device (not shown) that may be a socket, a ratchet, a wrench, a head, an extension, a bit, a drill bit and other devices known in the art. The sets of gears may include 1, 2, 3, 4, 5, 6, 7, 8, 9, 10 or more gears with different or similar tooth spacing. The drive extension 610 may be secured at one end by ring 660 and at the other end by ring 662.

In operation, the second connection aperture 638 is fitted to a device. As the second connection end 636 rotates the second set of gears 658 rotates and causes the second gear portion 654 to rotate. As the second gear portion 654 rotates the second gear plate 652 and first set of gears 634 are rotated to move first gear portion 618 and shaft 622 which extends through the first plate aperture 648 into the first connection end 616. The first connection end 616 can be attached to another device, e.g., socket, a ratchet, a wrench, a head, an extension, a bit, a drill bit and other devices known in the art. The first gear set 644 and second gear set 646 control the ratio of the input to output drive. For example the ratio may be 10:1, 12:1, 15:1, 20:1, 25:1, 50:1 and etc.

Figure 9A:
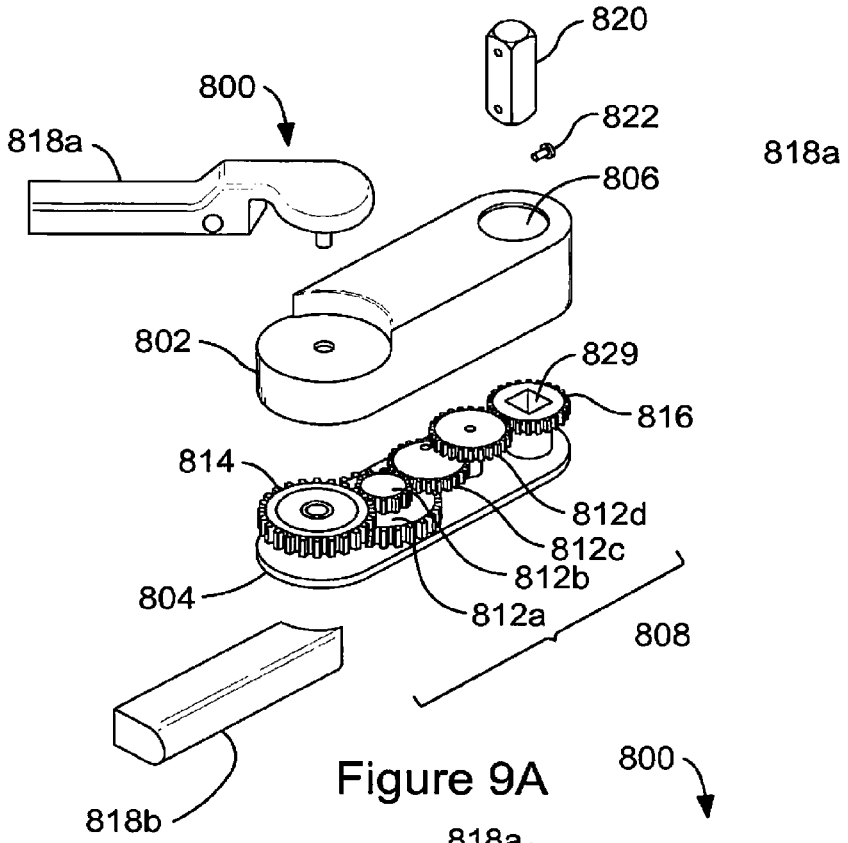
FIGS. 9A and 9B are images of a gear driven squeeze ratchet wrench.
Figure 9B:
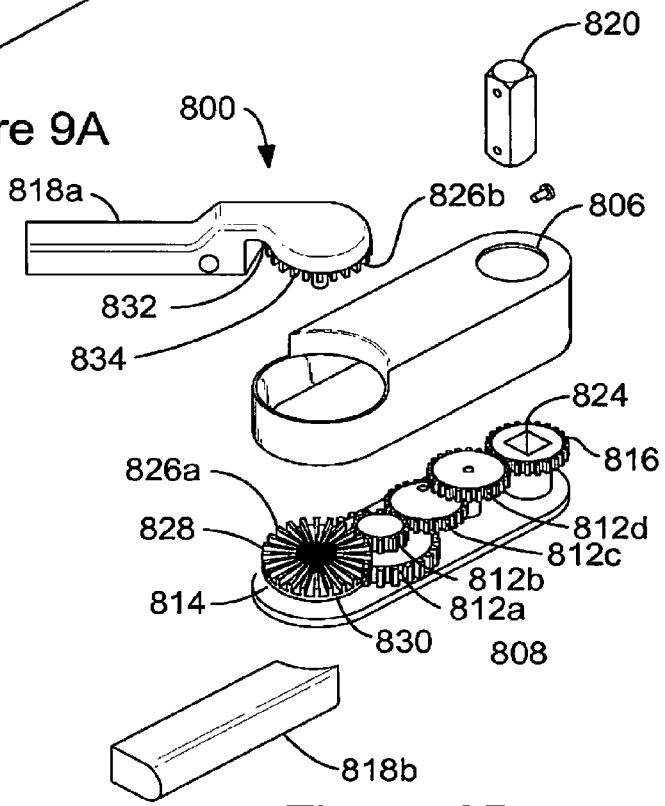

FIGS. 9A and 9B are images of a gear driven squeeze ratchet wrench 800. The gear driven squeeze ratchet wrench 800 of the instant invention includes an upper housing 802 and a lower housing 804 fitted to from a gear cavity 806 between the two. Located within the gear cavity 806 is a set of gears 810. The set of gears 808 may include 1, 2, 3, 4, 5, 6, 7, 8, 9, 10 or more gears 812*a*, 812*b*, 812*c* and 812*d* with different or similar tooth spacing and different gear ratios. The set of gears 808 may also include a handle adaptor gear 814 and a ratchet adaptor gear 816 in communication with the set of gears 808 to affix a first handle 818*a* and a drive adaptor 820. In one example, the set of gears 808 includes 4 gears having teeth around the periphery. Gear 812*a* includes teeth around the periphery to engage gear 808*c* and gear 812*b* rests atop gear 812*a* to contact gear 812*c*. Gear 808*c* has teeth that contact gear 812*d*. Gear 812*d* is connected to the ratchet adaptor gear 816 that receives the drive adaptor 820 and may be secured by screw 822. The first handle 818*a* is attached to the adaptor gear 814. As the first handle 818*a* and second handle 818*b* are squeezed together the first handle 818*a* rotates the handle adaptor gear 814 to rotate the set of gears 808. As such, the rotation of the first handle 818*a* causes the gear 812*a* to transfer this motion to the set of gears 808 and the final drive adaptor 820 through the set of gears 808. The second handle 818*b* may be located on the upper housing 802, the lower housing 804 or both. The set of gears 808 are connected to the second body 804 or positioned on an insert that is positioned on the lower housing 804, the upper housing 802 or both. The upper housing 802, the lower housing 804 or both may include a second handle 818*b* that provides leverage to turn the first handle 818*a*. In operation, the first handle 818*a* and second handle 818*b* are squeezed together to rotate the adaptor gear 814 that rotates the set of gears 808 which in turn rotates the ratchet adaptor gear 816 that receives the drive adaptor 820. In addition, the ratchet adaptor gear 816 includes an insert aperture 824 configured to fit the drive adaptor 820. Other embodiments, include ratchet adaptor gear 816 that may include an insert aperture 824 configured to fit a spline drive, a square bit, a polygonal bit and so forth (not shown).

FIG. 9B is an image of a gear driven squeeze ratchet wrench 800 having a pair of face gears. The gear driven squeeze ratchet wrench 800 of the instant invention includes an upper housing 802 and a lower housing 804 fitted to from a gear cavity 806 between the two. Located within the gear cavity 806 is a set of gears 810. The set of gears 808 may include 1, 2, 3, 4, 5, 6, 7, 8, 9, 10 or more gears 812*a*, 812*b*, 812*c* and 812*d* with different or similar tooth spacing and different gear ratios. The set of gears 808 may also include a handle adaptor gear 814 and a ratchet adaptor gear 816 in communication with the set of gears 808 to affix a first handle 818*a* and a drive adaptor 820. The handle adaptor gear 814 may include a set of face gears 826*a* with the teeth 830 set of face gears 826*a* disposed on the top face 828 of the handle adaptor gear 814 and numerous teeth 830 positioned around the periphery of the handle adaptor gear 814. The first handle 818*a* includes a mating set of face gears 826*b* disposed on the bottom face (not shown) of a face gear insert (not shown) positioned about a positioning cylinder 834 such that the teeth of the mating set of face gears 826*b* align. The set of gears 808 includes four gears having teeth around the periphery. Gear 812*a* includes teeth around the periphery to engage gear 808*c*, and gear 812*b* rests atop gear 812*a* to contact gear 812*c*. Gear 808*c* has teeth that contact gear 812*d*. Gear 812*d* is connected to the ratchet adaptor gear 816 that receives the drive adaptor 820 and may be secured by screw 822. The first handle 818*a* is attached to the adaptor gear 814. As the first handle 818*a* and second handle 818*b* are squeezed together the first handle 818*a* rotates the handle adaptor gear 814 to rotate the set of gears 808. As such, the rotation of the first handle 818*a* causes the gear 812*a* to transfer this motion to the set of gears 808 and the final drive adaptor 820 through the set of gears 808. The second handle 818*b* may be located on the upper housing 802, the lower housing 804 or both. The set of gears 808 are connected to the second body 804 or positioned on an insert that is positioned on the lower housing 804, the upper housing 802 or both. The upper housing 802, the lower housing 804 or both may include a second handle 818*b* that provides leverage to turn the first handle 818*a*. In operation, the first handle 818*a* and second handle 818*b* are squeezed together to rotate the adaptor gear 814 that rotates the set of gears 808 which in turn rotates the ratchet adaptor gear 816 that receives the drive adaptor 820. In addition, the ratchet adaptor gear 816 includes an insert aperture 824 configured to fit the drive adaptor 820. Other embodiments, include ratchet adaptor gear 816 may include an insert aperture 824 configured to fit a spline drive, a square bit, a polygonal bit and so forth (not shown).

The set of gears 808 can have a variety of configurations (increased ratio, decreased ratio, strength, size, etc.) depending on the space constraints and the specific application. For example, gear configurations may be used to provide an increase or a decrease in the drive ratio. A combination of gear teeth and gear arrangements may be used to allow the alteration of both torque and speed between the input and output values. For example, a combination of 8-tooth gears 8A, 8B and 8C and 40-tooth gears 40A, 40B and 40C allow a dramatic reduction in gearing ratios. For example, the final drive ratio between 8-tooth gear 8A and 40-tooth gear 40A is 125:1. This is achieved through the combination of the 8-tooth gear 8A driving the 40-tooth gear 40B at a 5:1 ratio and 8-tooth gear 8B driving the 40-tooth gear 40C and the 8-tooth gear 8C which drives the 40-tooth gear 40A to allow 100 rpm input to be converted to 0.8 rpm output (the converse may also be accomplished to drive a 0.8 rpm input to be converted to a 100 rpm output). Another example, includes a 40-tooth drive gear 40A is connected to a 8-tooth gear 8A to form a 1:5 ratio that turns 5 rpm per 1 rpm of the drive gear 40A. A 20-tooth gear 20A and a 40-tooth drive gear 40B are connected to the 40-tooth gear 40A to form a 1:2 and 1:1.66 ratio to turn 2 rpm and 1.66 rpm per 1 rpm of the drive gear, respectively.

Figure 10A:
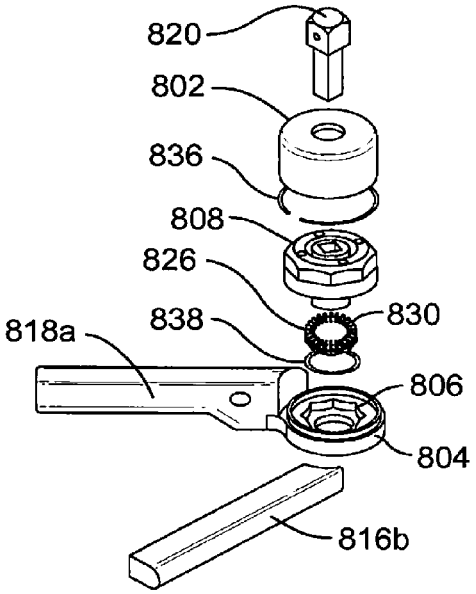
FIGS. 10A and 10B are images of a gear driven squeeze ratchet wrench having a pair of face gears.

FIG. 10A is an image of a gear driven squeeze ratchet wrench 800 having a pair of face gears. The gear driven squeeze ratchet wrench 800 of the instant invention includes an upper housing 802 and a lower housing 804 fitted to from a gear cavity 806 between the two. In operation the first handle 818*a* and second handle 818*b* are squeezed together to rotate the drive adaptor 820. The first handle 818*a* and second handle 818*b* are connected to different portions of the upper housing 802 and/or the lower housing 804. Located within the gear cavity 806 is a set of gears 808. The set of gears 808 may include 1, 2, 3, 4, 5, 6, 7, 8, 9, 10 or more gears with different or similar tooth spacing and different gear ratios. The set of gears 808 may be connected to the lower housing 804 by a set of face gears 826 disposed in the gear cavity 806 that mate to set of face gears (not shown) on the bottom of the set of gears 808. The set of gears 808 are connected to a drive adaptor 820 that extends from the upper housing 802 and is retained by device 836. The set of face gears 826 and the mating set of face gears (not shown) mate to allow the teeth (not shown) of the mating set of face gears (not shown) to pass by the teeth 830 on the set of face gears 826 when rotated in one direction and lock together when rotated in the other direction. A directional selector may be used in this embodiment. A biasing mechanism 838 may be placed between the set of face gears 826 and the bottom of the lower housing 804 (e.g., a button mechanism may also be incorporated into various embodiments). In operation the first handle 818*a* and second handle 818*b* are squeezed together to rotate the set of face gears 826 and the mated to set of face gears (not shown) on the bottom of the set of gears 808. As the mated to set of face gears (not shown) rotate the set of gears 808 are rotated and in turn rotate the drive adaptor 820 that extends from the upper housing 802.

Figure 10B:
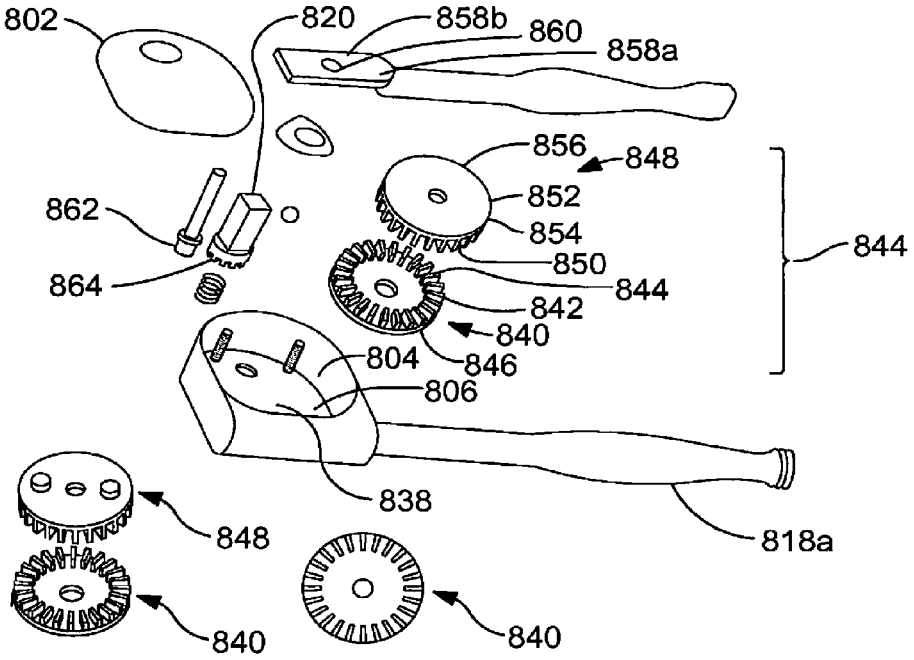

FIG. 10B is an image of a gear driven squeeze ratchet wrench 800 having a pair of face gears. The gear driven squeeze ratchet wrench 800 of the instant invention includes an upper cover 802 and a lower housing 804 fitted to from a gear cavity 806 between the two. The gear cavity 806 also includes an alignment post 838. In operation the first handle 818*a* and second handle 818*b* are squeezed together to rotate the drive adaptor 820. The first handle 818*a* and second handle 818*b* are connected to different portions of the upper housing 802 and/or the lower housing 804. Located within the gear cavity 806 is a set of gears 808. The set of gears 808 include a first face gear 840 having a first set of teeth 842 positioned around the periphery of the first face gear 840 and a set of first face gear face teeth 844 positioned on the top surface of the first face gear 840. The first face gear 840 also includes a first face gear alignment aperture 846. The set of gears 808 include a second face gear 848 having a set of second face gear face teeth 850 positioned on the bottom surface 852 of the second face gear 848. The second face gear 848 is connected to the second handle 818*b* such that the motion of the second handle 818*b* rotates the second face gear 848. In FIG. 10B the second face gear 848 has a pair of handle studs 856 fit in the stud apertures 858*a* and 858*b* of the second handle 818*b*. The second handle 818*b* also includes a handle alignment aperture 860 that receives the alignment post 838. A drive adaptor 820 is positioned in the gear cavity 806 by positioning on the drive adaptor stud 862 secured to the lower housing 804. The drive adaptor 820 includes adaptor teeth 864 that mate to the first set of teeth 842 positioned around the periphery of the first face gear 840. As the first face gear 840 rotates the first set of teeth 842 positioned around the periphery rotate the adaptor teeth 864 to rotate the drive adaptor 820. The set of second face gear face teeth 850 align on the bottom surface 852 of the second face gear 848 with the set of first face gear face teeth 844 positioned on the top surface of the first face gear 840. The second face gear 848 also includes a second face gear alignment aperture 854. The alignment post 838 is fitted into the first face gear alignment aperture 846 to position the first face gear 840 within the gear cavity 806 so that the set of first face gear face teeth 844 are facing upward from the gear cavity 806. The second face gear 848 is positioned such that the set of second face gear face teeth 850 align with the set of first face gear face teeth 844 by fitting the second face gear alignment aperture 854 with the alignment post 838. In an alternative embodiment, the second handle 818*b* includes the second face gear face teeth 850 to contact the first face gear 840. Similarly, the second face gear 848 may be circular, oval, square, segments of teeth or any other shape that provides a contact for the teeth. As in any of the examples provided herein, the gear ratio may be altered to any suitable ratio by alteration of the teeth, spacing, size, location etc of the gear and/or the teeth, e.g., the ratio may be 1.5:1, 2.5:1, 3.5:1, 4.5:1, 5.5:1, 6.5:1, 7.5:1, 8.5:1, 9.5:1, 10.5:1, 1:1, 2:1, 3:1, 4:1, 5:1, 6:1, 7:1, 8:1, 9:1, 10:1, 11:1, 12:1, 13:1, 14:1, 15:1, 20:1, 25:1, 50:1 and etc and the ratio may apply to the ratio in the opposite direction as well 50:1, etc.

Figure 11:
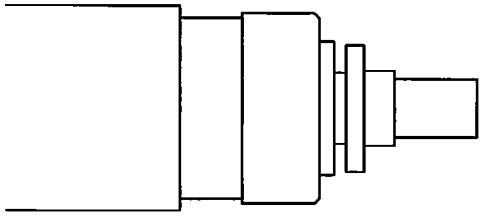
FIG. 11 is an image of one embodiment of the present invention that includes a 1:1 direct drive used to apply torque.

FIG. 11 is an image of one embodiment of the present invention that includes a 1:1 direct drive used to apply torque. Applying pressure to the device presses the gears together allowing a locking of the teeth of the gears.

Figure 12:
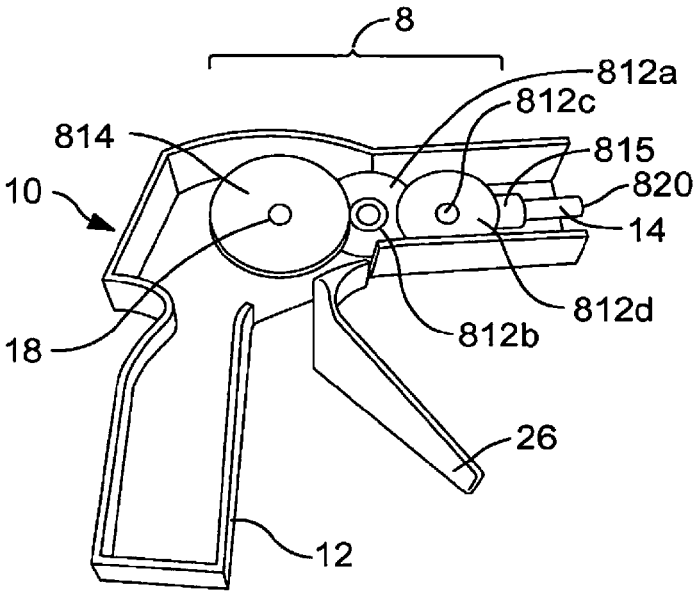
FIG. 12 is an image of one embodiment of the squeeze driver of the present invention.

FIG. 12 is an image of one embodiment of the squeeze driver of the present invention. The housing 10 encloses a gear body 8 comprising a drive gear 814 mounted on a shaft 18 and 19. A rotatable extension shaft 14 and handle 12 extend outwardly from the housing. The trigger 26 engages the gear 814.

Figure 13:
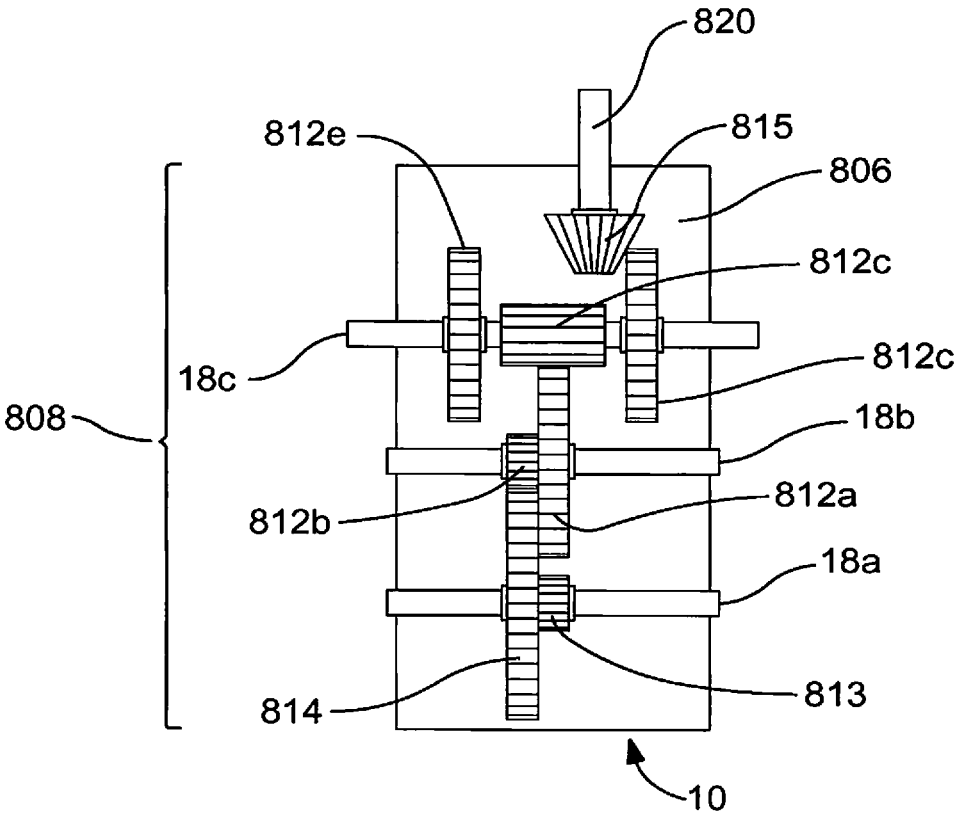
FIG. 13 is a top view of a gear driven squeeze gear body.

FIG. 13 is a top view of a gear driven squeeze gear body 8. Located within the gear cavity 806 is a set of gears 808. The set of gears 808 may include 1, 2, 3, 4, 5, 6, 7, 8, 9, 10 or more gears 812*a*, 812*b*, 812*c*, 812*d*, 812*e*, 814, and 815 with different or similar tooth spacing and different gear ratios. The set of gears 808 includes a handle drive gear 814 connected to shaft 18 and in communication with the set of gears 808 to affix a handle 26 and a drive adaptor 820. In one example, the set of gears 808 includes 7 gears having teeth around the periphery and/or the sides. The trigger 26 is attached to the adaptor gear 814. As the trigger 26 and handle 12 are squeezed together the trigger 26 rotates the adaptor gear 814 about the shaft 18 to rotate the set of gears 808. The adaptor gear 814 has teeth around the periphery to engage gear 812*b* which rotates about shaft 18*b*. Also attached to shaft 18*b* is gear 812*a* having teeth around the periphery to engage gear 812*c*. As the shaft 18*b* is rotated by gear 812*b*, the gear 812*a* will also rotate. Gear 812*a* engages gear 812*c* about shaft 18*c*. Shaft 18*c* has 2 gears, gear 812*d* and gear 812*e* positioned on either side of pinion gear 815. As gear 812*c* rotates shaft 18*c*, the gear 812*d* and gear 812*e* rotate and turn rotates the final drive adaptor 820. The actual gearing can be adjusted to provide the desired ratio by the changing of the diameter and number of teeth in one or more gears of the set of gears 808. The drive adaptor 820 may include an insert aperture configured to fit a spline drive, a square bit, a polygonal bit and so forth (not shown). The drive adaptor 820 may be switched in the rotation direction by changing 1 or more shafts of the set of gears 808. For example, shaft 18*c* may be pressed to move the shaft to engage gear 812*e* to drive the drive adaptor 820 in a direction opposite the direction driven when gear 812*d* is in contact with pinion gear 815. This configuration may be used for any shaft and in any combination and may also be used to configure different gear ratios.

Figure 14:
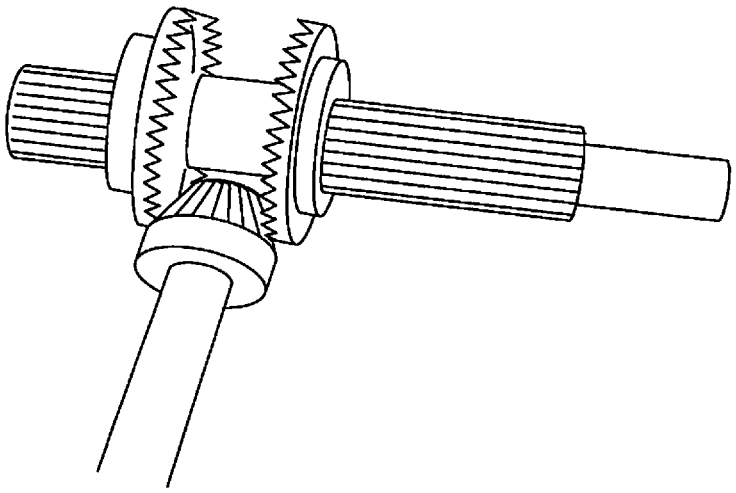
FIG. 14 is a view of the pinion gear setup set of gears of the present invention.

FIG. 14 is a view of the pinion gear setup set of gears of the present invention. The pinion gear drive system can also be use a ball pinion gear with swivel teeth allowing rotations on end so that the pinion shaft can move at multiple angles with using concaved side pinion gears.

Figure 15A:
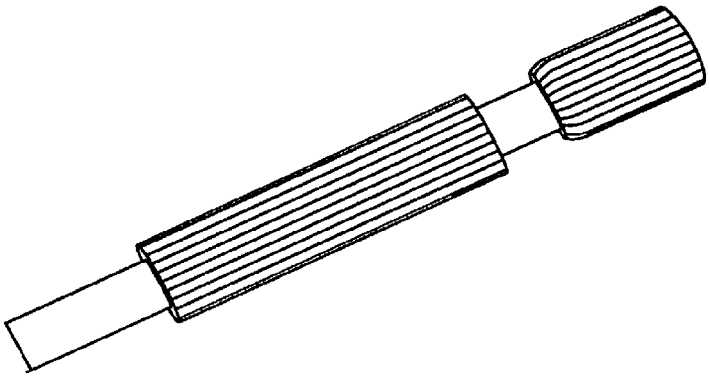
FIGS. 15*a*, 15*b* and 15*c* are images of the shafts that can be used in the present invention to switch the direction of the rotation of the extension shaft.
Figure 15B:
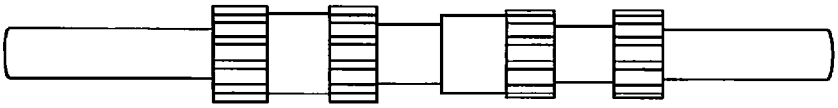
Figure 15C:
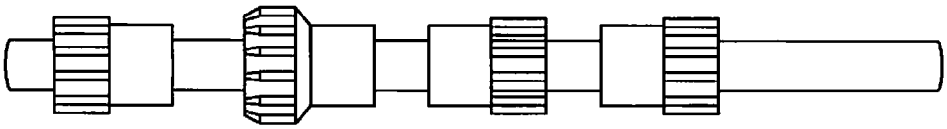

FIGS. 15*a*, 15*b* and 15*c* are images of the shafts 18 that can be used in the present invention to switch the direction of the rotation of the extension shaft.

Figure 16:
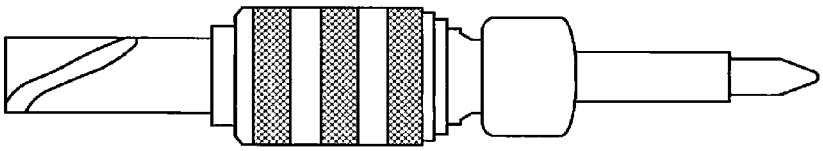
FIG. 16 is an image of another embodiment of the drive device of FIGS. 12 and 13 connected to a connected a drive shaft.

FIG. 16 is an image of the drive device of FIGS. 12 and 13 connected to a connected a drive shaft. The shaft drive handle (not shown) is slide down shaft and in turn rotates the drive device multiple times.

Figure 17:
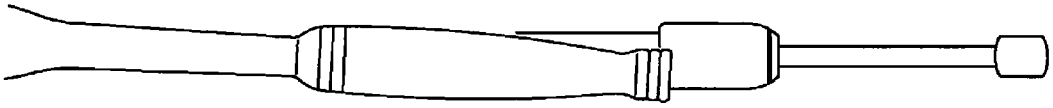
FIG. 17 is an image of another embodiment of the drive device of FIGS. 12 and 13 connected to a connected a drive shaft.

FIG. 17 is an image of the drive device of FIGS. 12 and 13 connected to a connected a drive shaft. The shaft drive handle (not shown) in the form of a wrench or a ratchet where the shaft is rotated by sliding the wrench or a ratchet (not shown) down the shaft and in turn rotates the drive device multiple time.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A handheld device for rotating a drive shaft comprising:
- a housing comprising a handle extending from a gear housing;
- a first shaft that extends rotatably through the housing;
- a first drive gear secured to the first shaft;
- a trigger pivotably connected to the first shaft to position the trigger adjacent to the handle, wherein the movement of the trigger rotates the first shaft and first drive gear;
- a second shaft gear in contact with the first drive gear and supported on a second shaft that extends rotatably through the housing;
- a second drive gear positioned on the second shaft;
- a third shaft gear in contact with the second drive gear and supported on a slidable third shaft that extends rotatably through the housing and is slidable in the housing and the third shaft gear remains in contact with the second drive gear when slid;
- a third forward gear attached to the slidable third shaft on one side of the third shaft gear;
- a third reverse gear attached to the slidable third shaft on the other side of the third shaft gear;
- a pinion gear positioned between the third forward gear or the third reverse gear to engage selectively the third forward gear or the third reverse gear as a result of the position of the slidable third shaft; and
- a pinion shaft extending outwardly from the pinion gear through the housing, wherein the movement of the trigger rotates the gears to rotate the pinion shaft.

2. The device of claim 1, wherein the housing is constructed from a metal, an alloy, a plastic, a composite material or any combinations thereof.

3. The device of claim 1, wherein the pinion shaft comprises a head to fit a socket.

4. The device of claim 1, wherein the pinion shaft comprises a head to fit a hex.

5. The device of claim 1, wherein the pinion shaft comprises a head to fit a bit.

6. The device of claim 1, wherein the pinion shaft turns at a ratio of at least 1.5:1, 2.5:1, 3.5:1, 4.5:1, 5.5:1, 6.5:1, 7.5:1, 8.5:1, 9.5:1, 10.5:1, 1:1, 2:1, 3:1, 4:1, 5:1, 6:1, 7:1, 8:1, 9:1, 10:1, 11:1, 12:1, 13:1, 14:1, 15:1, 20:1, 25:1, 50:1, 60:1, 70:1, 80:1, 90:1, 100:1, 125:1, 150:1, 175:1, 200:1, 225:1, 250:1, 275:1, 300:1, 325:1, 350:1, 375:1, 400:1, 450:1, 475:1, 500:1, when compared to the trigger motion.

7. The device of claim 1, wherein the pinion shaft further comprises a direct drive gear to lock the pinion shaft.

8. A handheld device for rotating a drive shaft comprising:
- a housing comprising a handle extending from a gear housing;
- a first shaft that extends rotatably through the housing;
- a first drive gear secured to the first shaft;
- a trigger pivotably connected to the first shaft to position the trigger adjacent to the handle, wherein the movement of the trigger rotates the first shaft and first drive gear;
- a second shaft gear in contact with the first drive gear and supported on a slidable second shaft that extends rotatably through the housing and is slidable in the housing and the second shaft gear remains in contact with the first drive gear when slid;
- a second forward gear attached to the slidable second shaft on one side of the second shaft gear;
- a second reverse gear attached to the slidable second shaft on the other side of the second shaft gear;
- a pinion gear positioned between the second forward gear or the second reverse gear to engage selectively the second forward gear or the second reverse gear as a result of the position of the slidable second shaft; and
- a pinion shaft extending outwardly from the pinion gear through the housing, wherein the movement of the trigger rotates the gears to rotate the pinion shaft.

9. The device of claim 8, wherein the housing is constructed from a metal, an alloy, a plastic, a composite material or any combinations thereof.

10. The device of claim 8, wherein the pinion shaft comprises a head to fit a socket.

11. The device of claim 8, wherein the pinion shaft comprises a head to fit a hex.

12. The device of claim 8, wherein the pinion shaft comprises a head to fit a bit.

13. The device of claim 8, wherein the pinion shaft turns at a ratio of at least 1.5:1, 2.5:1, 3.5:1, 4.5:1, 5.5:1, 6.5:1, 7.5:1, 8.5:1, 9.5:1, 10.5:1, 1:1, 2:1, 3:1, 4:1, 5:1, 6:1, 7:1, 8:1, 9:1, 10:1, 11:1, 12:1, 13:1, 14:1, 15:1, 20:1, 25:1, 50:1, 60:1, 70:1, 80:1, 90:1, 100:1, 125:1, 150:1, 175:1, 200:1, 225:1, 250:1, 275:1, 300:1, 325:1, 350:1, 375:1, 400:1, 450:1, 475:1, 500:1, when compared to the trigger motion.

14. The device of claim 8, wherein the pinion shaft further comprises a direct drive gear to lock the pinion shaft.

15. A device for pulling-out or pushing-in a screw comprising:
- a housing;
- a gear body disposed in the housing wherein a protruding shaft moveably secures perpendicular to a bottom gear and a top gear;
- a trigger that engages the bottom gear and the top gear, wherein the trigger moves the top gear and the bottom gear;
- the trigger selectively engages the bottom gear wherein rotation of the bottom gear in a first rotational direction rotates the top gear and rotation of the bottom gear in a second rotational direction rotates the top gear in an opposite direction;

a rotatable shaft extending outwardly from the housing body;

one or more cylindrical pieces comprising a pinion gear and a screw opposite the pinion gear disposed in the rotatable shaft;

the rotatable shaft selectively rotates the pinion gear in a first rotational direction or a second rotational direction opposite the first rotational direction;

a handle to grip while the trigger sets in motion the bottom gear and the top gear and the one or more cylindrical pieces and the screw.

16. The device of claim 15, wherein the housing is constructed from a metal, an alloy, a plastic, a composite material or any combinations thereof.

17. The device of claim 15, wherein the protruding shaft optionally locks the bottom gear or the top gear by a clockwise or a counter-clockwise rotation of the bottom gear or the top gear.

18. The device of claim 15, wherein the trigger engages by a clockwise or a counter-clockwise rotation the bottom gear or the top gear.

19. The device of claim 15, wherein the one or more cylindrical pieces is constructed from a metal, an alloy, a plastic, a composite material or any combinations thereof.

* * * * *